US011156425B2

(12) United States Patent
Dvorak

(10) Patent No.: US 11,156,425 B2
(45) Date of Patent: Oct. 26, 2021

(54) COMPOSITE STRIKER FOR FIREARM SIMULATOR

(71) Applicant: Vojtech Dvorak, Tulsa, OK (US)

(72) Inventor: Vojtech Dvorak, Tulsa, OK (US)

( * ) Notice: Subject to any disclaimer, the term of this patent is extended or adjusted under 35 U.S.C. 154(b) by 459 days.

(21) Appl. No.: 16/254,253

(22) Filed: Jan. 22, 2019

(65) Prior Publication Data

US 2019/0226792 A1 Jul. 25, 2019

Related U.S. Application Data

(60) Provisional application No. 62/620,348, filed on Jan. 22, 2018.

(51) Int. Cl.

| | |
|---|---|
| ***F41A 33/06*** | (2006.01) |
| ***F41A 19/13*** | (2006.01) |
| ***F41A 33/00*** | (2006.01) |

(52) U.S. Cl.

CPC ..... *F41A 33/06* (2013.01); *F41A 19/13* (2013.01); *F41A 33/00* (2013.01)

(58) Field of Classification Search

CPC ..... F41A 33/00; F41A 33/02; F41A 33/04; F41A 33/06; F41A 19/13

See application file for complete search history.

(56) References Cited

U.S. PATENT DOCUMENTS

| | | | | |
|---|---|---|---|---|
| 4,486,966 | A | 12/1984 | Seehase | |
| 4,635,530 | A | 1/1987 | Weldle | |
| 5,435,090 | A | 7/1995 | Darrow | |
| 9,297,607 | B2 | 3/2016 | Dvorak | |
| 2001/0007228 | A1 | 7/2001 | Proffitt | |
| 2004/0200113 | A1 | 10/2004 | Lawless | |
| 2006/0265929 | A1 | 11/2006 | Haney | |
| 2012/0129136 | A1 | 5/2012 | Dvorak | |
| 2014/0224114 | A1 | 8/2014 | Faxon | |
| 2017/0167819 | A1* | 6/2017 | Myers | G09B 9/00 |
| 2018/0149443 | A1* | 5/2018 | Dottle | F41A 33/02 |

OTHER PUBLICATIONS

International Search Report and Written Opinion dated May 1, 2019 Issued by the ISA/US for PCT/US2019/014610.

* cited by examiner

*Primary Examiner* — Timothy A Musselman

(74) *Attorney, Agent, or Firm* — Scott R. Zingerman

(57) ABSTRACT

A composite striker for a firearm simulator which employs a firing pin and provides pneumatic recoil. The composite striker including at least a first segment constructed of a material which is softer than the firing pin and at least a second segment being suitable for displacing a valve in order to initiate the pneumatic recoil.

20 Claims, 4 Drawing Sheets

COMPOSITE STRIKER FOR FIREARM SIMULATOR

CROSS-REFERENCE TO RELATED CASES

This application claims the benefit of U.S. provisional patent application Ser. No. 62/620,348, filed on Jan. 22, 2018, and incorporates such provisional application by reference into this disclosure as if fully set out at this point.

FIELD OF THE INVENTION

This disclosure relates generally to firearm simulators wherein an actual firearm is converted to a compressed gas powered weapon which simulates the live firing action of the actual firearm and more particularly to components which receive a strike impulse from the firing pin of the actual firearm.

BACKGROUND OF THE INVENTION

Firearms have been converted into firearm simulators by replacement of parts of the firearm with simulator parts for simulated shooting such that the resultant firearm comprises a combination of actual firearm components and simulated firearm components. The simulated firearm components have included a simulated barrel unit and a simulated magazine unit. The actual firearm components could preferably be switched back so as to convert the firearm back to an actual firearm capable of firing live ammunition.

The prior simulated magazine units have included a compressed gas container or a connection to an external compressed gas source. The compressed gas is used to provide energy to operate the weapon simulator by actuating valve means in the simulated barrel unit. The compressed gas is conducted from the compressed gas container, or the external compressed gas source to the simulated barrel unit.

When actuated, the valve means forces movement of a slide and compression of a recoil spring and subsequent venting. The resulting recoil simulates the feel of an actual weapon firing using live ammunition.

One problem which has been reported by those who have converted their firearm to a simulated firearm is that firing pin which has not been substituted can become worn, blunted, or bent over time due to repeated strikes to the mechanism in the simulated barrel. The mechanism struck is often a component known as a striker. This wear often requires replacement of the firing pin, particularly if it is to be converted back to fire live ammunition. It would be advantageous to improve simulated weapon design with a striker that does not cause wear to the firing pin of the actual weapon. It would further be advantageous for the striker to be constructed of a material which is not as hard, or softer than the material from which the firing pin (or at least its end which contacts the striker) is constructed. An additional need exists for the striker to be constructed of a material which does not cause wear to the firing pin but still adequately serves its function in the mechanism which provides the simulated recoil.

A laser beam pulse mechanism may be included which is responsive to the simulated weapon firing whereby the laser beam pulse mechanism emits a laser beam onto a target.

The hardness of a material is defined as its resistance to deformation, or being scratched, dented, indented, or deformed. This may, often, refer to the surface of the material (such as, for example, in the case of scratch resistance) or it may refer to the material itself (such as, for example, in the case of material deformation). The Rockwell hardness tester/scale is frequently used to obtain hardness values of materials. A higher Rockwell hardness number (for a given scale) corresponds to a harder number while a lower Rockwell hardness number (or as applied to a different scale) corresponds to a softer material. The Rockwell hardness classifications based on Rockwell scales are known and include the following (incorporated fully herein by reference):

- Rockwell metal hardness: HRA, HRB, HRC, HRD;
- Superficial Rockwell hardness: 15N, 30N, 45N, 15T, 30T, 45T, 15W, 30W, 45W, 15X, 30X, 45X, 15Y, 30Y, 45Y;
- Plastic Rockwell hardness: HRR, HRE, HRL, HRM HRK.

United States and International standards (incorporated fully herein by reference) are known and apply to hardness testing, including:

- International (ISO) standards:
  - ISO 6508-1: Metallic materials—Rockwell hardness test—Part 1: Test method (scales A, B, C, D, E, F, G, H, K, N, T);
  - ISO 2039, 2039-2: Plastics—Determination of hardness—Part 2: Rockwell hardness
- US (ASTM) standards:
  - ASTM E18: Standard methods for Rockwell hardness and Rockwell superficial hardness of metallic materials;
  - ASTM D785, D785-03, D785-08(2015): Standard methods for Rockwell hardness of plastics.

SUMMARY OF THE INVENTION

The invention of the present disclosure is a composite striker for a firearm simulator which employs a firing pin and provides pneumatic recoil. The composite striker including at least a first segment constructed of a material which is softer than the firing pin and at least a second segment being suitable for displacing a valve in order to initiate the pneumatic recoil.

As used herein, the term "composite" shall mean that the striker of the present disclosure is constructed of at least two segments. However, it should be understood that the at least two components may, in certain embodiments be constructed of the same material or different materials.

As used herein, the term "softer" shall mean a material that is suitable such that, when the striker is impacted repeatedly by a firing pin, the material will dent, indent, or deform such that it will not cause the firing pin to wear, blunt, or mushroom, and thereby requiring replacement. The hardness (such as the Rockwell hardness of the material, is less so as to reduce wear on the firearm firing pin. Accordingly, the firing pin would be expected to last for a number of cycles of the firearm which approximates or exceeds the number of cycles in an actual firing environment using live ammunition.

The present disclosure describes a composite striker for a firearm simulator which employs a metal firing pin and provides pneumatic recoil. The composite striker includes at least a first segment constructed of a material which is softer than the metal firing pin and at least a second segment configured for displacing a valve in order to initiate the pneumatic recoil. The first segment and the second segment are preferably joined together and may be constructed of the same material or different materials. The first segment and the second segment may be constructed of a single piece and molded together and/or may be a single material, such a fiberglass, as a non-limiting example.

In one preferred embodiment, the second segment includes a proximal end and a distal end. The proximal end includes a saddle extending therefrom. The first segment is configured as a cap having a cavity adapted to receive the saddle. The saddle may be substantially cylindrical having a diameter and the cavity in the cap being substantially cylindrical and having a diameter capable of receiving the saddle. The saddle includes a length and the cavity includes a depth capable of receiving the length of the saddle.

The proximal end of the second segment may be substantially cylindrical having an external diameter and the cap may be substantially cylindrical and having an external diameter such that when the saddle is received in the cavity, the external diameter of the proximal end of the second segment is substantially the same as the external diameter of the cap.

The saddle may include an external circumference including threads thereon and the cavity may include an internal circumference including threads which mate the threads of the external circumference of the saddle.

In another preferred embodiment the first segment is configured as a substantially cylindrical plug and the second segment is configured to receive the cylindrical plug. In this embodiment, the second segment includes a proximal end and a distal end such that the proximal end includes a cylindrical cavity configured to receive the plug and the distal end is configured for displacing the valve. The plug may include a length and the cylindrical cavity configured to have a depth such that said depth is capable of receiving the length of the plug. The plug may also include an external circumference having threads thereon and the cavity having an internal circumference including threads which mate the threads of the external circumference of the plug.

In another alternate embodiment the first segment of the composite striker includes a bung and the second segment includes a proximal end and a distal end. The proximal end of the second segment includes a cavity to receive the bung. The first segment includes a substantially cylindrical shoulder having a diameter and the bung being substantially cylindrical such that the diameter of the shoulder is greater than the diameter of the bung. The cavity being cylindrical and of a diameter capable of receiving the bung.

The bung may include an external circumference including threads thereon and the cavity may include an internal circumference including threads which mate the treads of the external circumference of the bung.

The present disclosure further describes a striker for a firearm simulator which is intended to be struck by the end of a firing pin to initiate a simulated firearm recoil. The striker includes a first segment and a second segment. The first segment is constructed of a material capable of being struck repeatedly by the firing pin of the firearm without blunting or deforming the firing pin. The material is preferably softer than the material from which the firing pin is constructed. The said second segment is preferably configured for initiating the simulated recoil, preferably by displacing a pneumatic valve. The second segment is preferably joined to the first segment The composite striker for a firearm simulator of the present disclosure which is struck by a metal firing pin to initiate pneumatic recoil and including a second segment configured for displacing a valve in order to initiate pneumatic recoil such that the composite striker includes a first segment being constructed of a material which is softer than the metal firing pin and adapted for being joined to the second segment. In this way, the first segment may be sold as a consumable replacement part to be joined to an existing second segment, particularly in an embodiment wherein the striker is not removable from the simulated barrel assembly.

The foregoing has outlined in broad terms the more important features of the invention disclosed herein so that the detailed description that follows may be more clearly understood, and so that the contribution of the instant inventors to the art may be better appreciated. The instant invention is not limited in its application to the details of the construction and to the arrangements of the components set forth in the following description or illustrated in the drawings. Rather the invention is capable of other embodiments and of being practiced and carried out in various other ways not specifically enumerated herein. Additionally, the disclosure that follows is intended to apply to all alternatives, modifications and equivalents as may be included within the spirit and the scope of the invention as defined by the appended claims. Further, it should be understood that the phraseology and terminology employed herein are for the purpose of description and should not be regarded as limiting, unless the specification specifically so limits the invention.

DETAILED DESCRIPTION OF THE PREFERRED EMBODIMENTS

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention.

The composite striker of the present disclosure may, in a preferred embodiment, be used in association with an apparatus for conversion of a firearm adapted for and capable of firing live ammunition into a compressed gas powered firearm simulator adapted for simulated shooting. The firearm simulator includes a combination of actual firearm components and simulated firearm components.

Figure 10:
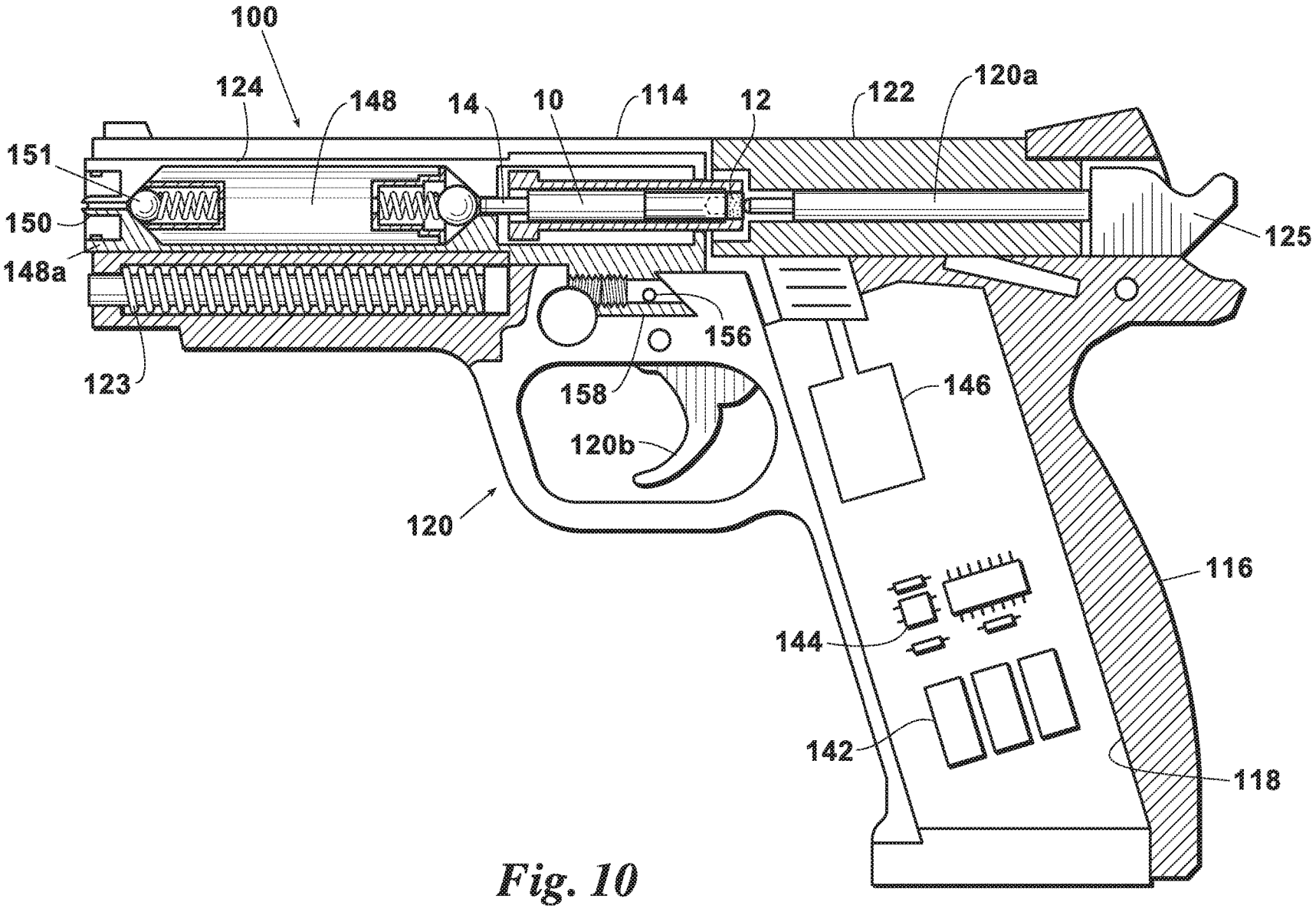
FIG. 10 is a cut-away side view illustrating an example embodiment of a handgun configured for simulated firing and including the composite striker of the present disclosure.

By way of example, in a preferred embodiment, and with reference to FIG. 10, the firearm may be a handgun 100. Handgun 100 includes a frame 114 having a grip portion 116, a magazine portion 118, a trigger portion 120, a slide portion 122 and a recoil spring 123, all of which are preferably components from the actual firearm. A firearm barrel portion of the actual firearm (not shown) is replaced by a simulated barrel unit 124. Although the composite striker of the present disclosure is particularly suited for handgun simulators, it is contemplated that it may also be applicable to certain long gun simulator designs (not shown) which may include a rifle or shotgun of the repeating, single shot, semiautomatic, or full automatic type.

Additional features of handgun simulator 100 include a simulated magazine unit 140 which may be inserted in grip portion 116 of frame 114 in a manner similar to the magazine of the actual firearm. Simulated magazine unit 140 may include a shot counter 142, a receiver and electronics 144 for receiving a remote signal to simulate a jam in firearm 100, and an actuator 146 to interrupt simulated firing in response to a predetermined number of simulated shots being fired by handgun 100.

The simulated barrel unit 124, FIG. 10, includes a reservoir or chamber 148 for sealingly storing a compressed gas such as CO2. One end 148*a* of cylinder 148 is threaded and includes a fill port 150 which may be of the male or female type and a check valve 151. Also, it should be understood by one of skill in the art that end 148*a* may be a twist-lock, a quick-lock or a bayonet type of latching mechanism as an alternative to being threaded. The threaded end 148*a* of the preferred embodiment can threadably receive a laser unit (not shown). The laser unit may be sight adjustable, and is preferably threadably removable from end 148*a* to provide access to fill port 150. In addition, in an alternate embodiment, reservoir 148 may be attached to a larger capacity auxiliary reservoir to increase the available number of simulated shots.

An adjustment screw 156 and pin 158 arrangement is provided adjacent the trigger portion 120 to take up play due to production tolerances in various handgun makes and models when simulated barrel unit 124 is installed in frame 114. The fill port 150 can be located in line with the end of barrel 124 or may be a side fill port on the side of a barrel in an alternate embodiment.

Still with reference to FIG. 10, handgun simulator 100 includes slide 122. Slide 122 includes firing pin 120*a*. Slide 122 and firing pin 120*a* are, in the preferred embodiment, the slide and firing pin from the actual firearm. Firing pin 120*a* is typically machined from metal and most typically of C-steel or hardened steel with a hardness above approximately 25 on the Rockwell C scale. It has been determined that a metal striker of approximately 25 HRC or above will damage firing pin 120*a* over time causing firing pin 120*a* to blunt or mushroom requiring replacement. The composite striker of the present disclosure overcomes this problem. It has been determined that a solid metal striker of approximately 20 HRC or below will not damage firing pin 120*a* for many cycles (approximately 3,000 cycles). However, such a striker may erode (and or split) after much fewer cycles (approximately 1,000 cycles). In this case, a composite striker having a first segment which is much softer, such as a polymer, mated to a second segment of a material such as described (20 HRC or below) is advantageous.

As discussed further below, firing pin 120*a* is positioned within slide 122 such that actuation of trigger 120*b* when firing a shot actuates firing pin 120*a* so that it is forced laterally within slide 122. In the handgun embodiment depicted in FIG. 10, actuation of trigger 120*b* causes hammer 125 to impact firing pin 120*a* forcing firing pin 120 to move laterally within slide 122 producing what shall be referred to herein as a strike impulse. It should be understood, however, that although all handguns have a firing pin which produces a strike impulse, not all handgun designs employ a hammer as depicted in FIG. 10. Such alternate handgun designs are known in the art.

When firing pin 120*a* produces the strike impulse in an actual firearm, firing pin 120*a* typically impacts a cartridge positioned in a firing chamber of the actual firearm barrel. Specifically, the firing pin 120*a* typically impacts a soft metal primer of the cartridge. The strike impulse is transferred to the primer such that the firing pin indents the soft metal primer initiating the charge which ignites the powder in the cartridge which, in turn, causes the bullet to unseat from the cartridge and exit the firearm through the barrel. The primer is designed with metal which is softer than firing pin 120*a* so that it will indent to initiate the charge properly but also so that it causes as little wear to firing pin 120*a* as is practical. Firing pin 120*a* must produce a strike impulse and contact every primer of every cartridge (round) which is fired by (cycled through) the handgun. Upon repeated firing, the firing pin will eventually wear out and must be replaced as is known in the art.

With respect to handgun simulator 100 of FIG. 10, as stated above, the actual handgun barrel is removed and replaced with simulated barrel unit 124. Simulated barrel unit 124 of the preferred embodiment includes a composite striker 10 of the present disclosure. Instead of striking a primer, in the handgun simulator 100, firing pin 120*a* impacts composite striker 10 upon a strike impulse in the manner discussed further below. The strike impulse is then transferred through composite striker 10, displacing it in order to displace a valve to initiate pneumatic recoil (discussed below) and thereby simulating actual handgun recoil. Composite striker 10 includes a first segment 12 constructed of a material which is softer than the firing pin 120*a* and a second segment 14 constructed of a material suitable for displacing the valve in order to initiate the pneumatic recoil.

As a result of this construction, firing pin 120*b* will impact, and transfer the strike impulse onto the softer first segment 12 of composite striker 10. First segment 12 of composite striker 10 acts as an anvil receiving repeated strikes (strike impulses) from firing pin 120*a*. The strike impulse is then transferred from first segment/anvil 12 to the second segment 14 and, therefore, through composite striker 10. It is desirable that first segment/anvil 12 be constructed of a material capable of receiving the strike impulse from firing pin 120*a* and transferring the strike impulse without permanent deformation. It has been found that one exemplary suitable softer material for the construction of first segment/anvil 12 is a nylon plastic available commercially as nylon rod from sources such as McMaster-Carr (part number 8538K13) 1901 Riverside Parkway, Douglasville, Ga. 30135-3150 USA (https://www.mcmaster.com/#8538k13/=1b89057). This suitable nylon material has a reported hardness of Rockwell R110-R115. It will be apparent to one of skill in the art that other suitable softer materials are available commercially for the construction of first segment/anvil 12 such as plastic materials which do not register a hardness value on the Rockwell C scale.

In an alternate embodiment, composite striker 10 could be configured such that first segment 12 and second segment 14 may be constructed from the same material (or in a most basic embodiment as a single element) which is softer than firing pin 120*a*. In this embodiment, the material must be suitable for the first segment to receive and transfer repeated strikes and strike impulses from firing pin 120*a* without permanent deformation. In addition, the material of second segment 14 must be sufficient to repeatedly unseat the pneumatic (tappet) valve upon each strike impulse. It has been determined that a material such as a polyamide-imide (PAI) material such as Torlon® produced by Solvay S. A. and available commercially from McMaster-Carr (part number 8566K81) 1901 Riverside Parkway, Douglasville, Ga. 30135-3150 USA (https://www.mcmaster.com/#8566k81/=1b890ux) which has a reported Rockwell hardness of Rockwell E80 (Rockwell M120).

Referring next to FIGS. 1-9 taken in combination with FIG. 10, several preferred embodiments of composite striker 10 shall be described. Each of the embodiments depicted in FIGS. 1-9 include two segments 12 and 14, it is contemplated that composite striker 10 could include additional segment(s) as desired or as may be required for a particular application/embodiment without departing from the scope of the present disclosure. However, it is contemplated that at least the first segment/anvil 12 be constructed of a material that is softer than that of firing pin 120*a*.

Figure 1:
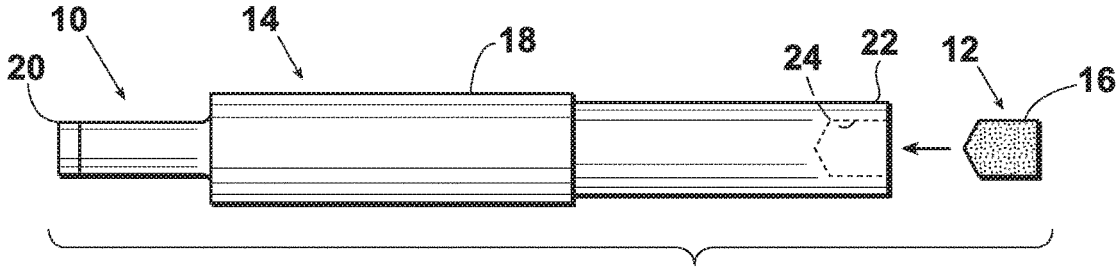
FIG. 1 is a side view of one preferred embodiment of the composite striker of the present disclosure.
Figure 2:
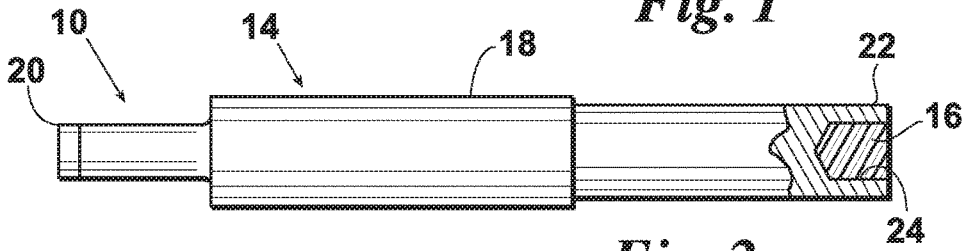
FIG. 2 is the composite striker of FIG. 1 with the proximal end partially cut-away.
Figure 3:
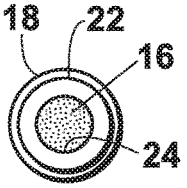
FIG. 3 is and end view of the preferred embodiment of the composite striker of FIG. 1.

With reference to FIGS. 1-3, a first preferred embodiment of the composite striker 10 of the present disclosure shall be described. Composite striker 10 includes a first segment/anvil 12 and a second segment 14. In the embodiment of FIGS. 1-3, first/anvil segment 12 is configured as a substantially cylindrical plug 16 and second segment 14 is configured to include a body 18 having a distal end 20 and a proximal end 22. A substantially cylindrical cavity 24 is drilled in proximal end 22 of body 18 to receive plug 16 therein. Cavity 24 is preferably drilled to have an internal diameter which is substantially the same as the diameter of plug 16 such that when plug 16 is inserted into cavity 24 (FIGS. 2-3), plug 16 fits tightly within cavity 24 to produce an interference fit. Plug 16 is substantially the same length as cavity 24 is deep such that plug 16 is preferably inserted completely into cavity 24.

The external circumference of plug 16, and the internal circumference of cavity 24 could include mating threads or serrations, or other suitable texture therein/thereon. Such threads or serrations or texture would increase the strength of the fit between plug 16 and cavity 24.

When the embodiment of composite striker 10 of FIGS. 1-3 is installed in a firearm simulator (such as 100 of FIG. 10) it is contemplated that firing pin 120*a* would strike plug 16 and transfer the strike impulse thereto. Plug 16 is constructed of a material which is softer than that of firing pin 120*a* such that plug 16 indents on impact without causing damage/wear to firing pin 120*a*. After repeated cycles of impacts from firing pin 120*a*, it is contemplated that preferably plug 16 is removed and a new plug replaced (inserted into cavity 24). Alternately, composite striker 10 could be removed and replaced in its entirety. In this way, composite striker 10 (or at least plug 16 thereof) becomes a consumable item while preserving firing pin 120*a*.

Figure 4:
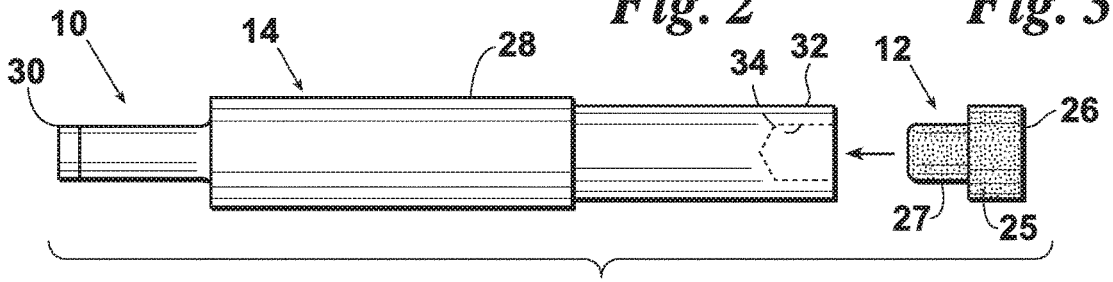
FIG. 4 is a side view of a second preferred embodiment of the composite striker of the present disclosure.
Figure 5:
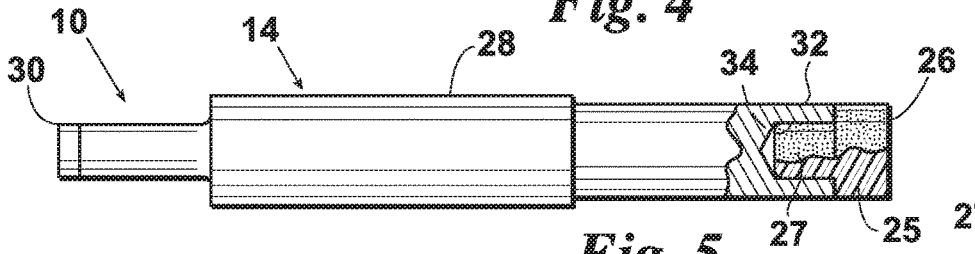
FIG. 5 is the composite striker of FIG. 4 with the proximal end partially cut-away.
Figure 6:
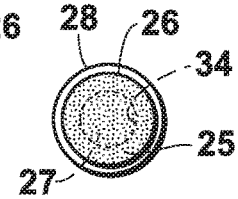
FIG. 6 is and end view of the preferred embodiment of the composite striker of FIG. 4.

A second preferred embodiment of composite striker 10 shall next be described in relation to FIGS. 4-6. Composite striker 10 includes a first segment/anvil 12 and a second segment 14. In the embodiment of FIGS. 4-6, first/anvil segment 12 is configured as a stopper 26. Stopper 26 is configured to include a substantially cylindrical shoulder 25 and a substantially cylindrical bung 27. The diameter of shoulder 25 being greater than the diameter of bung 27.

Second segment 14 is configured to include a body 28 having a distal end 30 and a proximal end 32. As with the first embodiment, a substantially cylindrical cavity 34 is drilled in proximal end 32 of body 28 to receive bung 27 therein. Cavity 34 is preferably drilled to have an internal diameter which is substantially the same as the diameter of bung 16 such that when bung 27 is inserted into cavity 34 (FIGS. 5-6), bung 27 fits tightly within cavity 34. Bung 27 is substantially the same length as cavity 34 is deep such that bung 27 is preferably inserted completely into cavity 34 and produces an interference fit in a preferred embodiment. The diameter of shoulder 25 being substantially the same as the diameter of proximal end 32 of body 28 of second segment 14.

The external circumference of bung 27, and the internal circumference of cavity 34 could include mating threads, serrations, or other suitable texture therein/thereon. Such threads or serrations would increase the strength of the fit between bung 37 and cavity 34.

When the embodiment of composite striker 10 of FIGS. 4-6 is installed in a firearm simulator (such as 100 of FIG. 10) it is contemplated that firing pin 120*a* would strike shoulder 25 of stopper 26 and transfer the strike impulse thereto. Stopper 26 is constructed of a material which is softer than that of firing pin 120*a* such that stopper 26 indents on impact without causing damage/wear to firing pin 120*a*. After repeated cycles of impacts from firing pin 120*a*, it is contemplated that preferably stopper 26 is removed and a new stopper replaced (inserted into cavity 24) in proximal end 32 of body 28. Alternately, composite striker 10 could be removed and replaced in its entirety. In this way, composite striker 10 (or at stopper 16 thereof) becomes a consumable item while preserving firing pin 120*a*.

Figure 7:
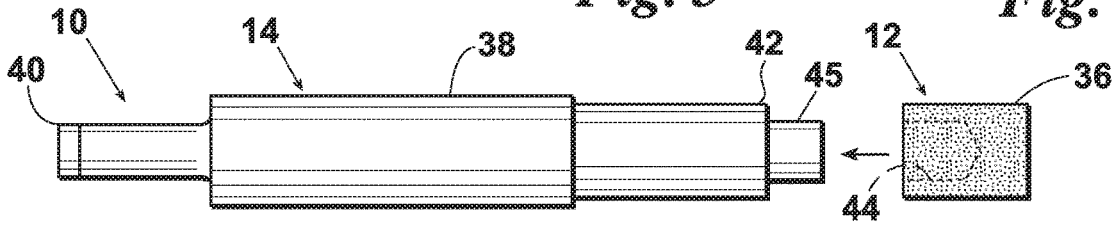
FIG. 7 is a side view of a third preferred embodiment of the composite striker of the present disclosure.
Figure 8:
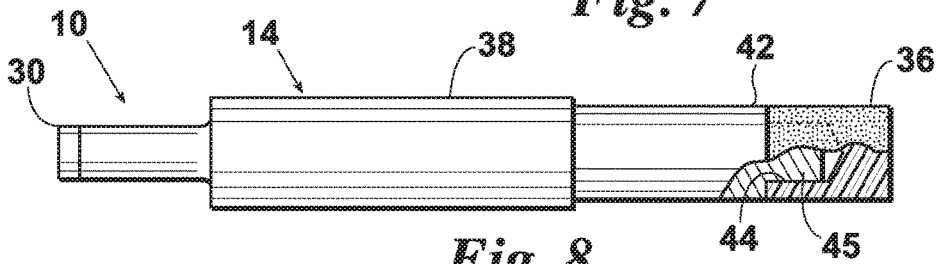
FIG. 8 is the composite striker of FIG. 7 with the proximal end partially cut-away.
Figure 9:
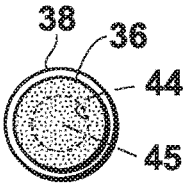
FIG. 9 is and end view of the preferred embodiment of the composite striker of FIG. 7.

With reference to FIGS. 7-9, a third preferred embodiment of composite striker 10 shall next be described. Composite striker 10 includes a first segment/anvil 12 and a second segment 14. In the embodiment of FIGS. 7-9, first/anvil segment 12 is configured as a cap 36. Cap 36 is configured to include a substantially cylindrical cavity 44 drilled therein.

Second segment 14 is configured to include a body 38 having a distal end 40 and a proximal end 42. In this embodiment, a substantially cylindrical saddle 45 is machined so as to extend from proximal end 42 of body 38 to receive cap 36 thereon. Cavity 44 of cap 36 is preferably drilled to have an internal diameter which is substantially the same as the diameter of saddle 45 such that when cap 36 is placed over saddle 45 such that saddle 45 extends into cavity 44 (FIGS. 8-9), saddle 45 fits tightly within cavity 44. In this way, cap 36 fits snugly on saddle 45. Saddle 45 is substantially the same length as cavity 44 is deep such that saddle 45 is preferably inserted completely into cavity 44 of cap 36 such that when inserted, an interference fit maintains cap 36 onto saddle 45. The diameter of cap 36 being substantially the same as the diameter of proximal end 42 of body 38 of second segment 14.

The external circumference of saddle 45, and the internal circumference of cavity 44 could include mating threads, serrations or other suitable texture therein/thereon. Such threads, serrations or other suitable texture would increase the strength of the fit between saddle 45 and cavity 44.

When the embodiment of composite striker 10 of FIGS. 7-9 is installed in a firearm simulator (such as 100 of FIG. 10) it is contemplated that firing pin 120*a* would strike cap 36 and transfer the strike impulse thereto. Cap 36 is constructed of a material which is softer than that of firing pin 120*a* such that cap 36 indents on impact without causing damage/wear to firing pin 120*a*. After repeated cycles of impacts from firing pin 120*a*, it is contemplated that preferably cap 36 is removed and a new cap replaced (inserted into cavity 24) on proximal end 42 of body 38. Alternately, composite striker 10 could be removed and replaced in its entirety. In this way, composite striker 10 (or at least cap 36 thereof) becomes a consumable item while preserving firing pin 120*a*.

Figure 11:
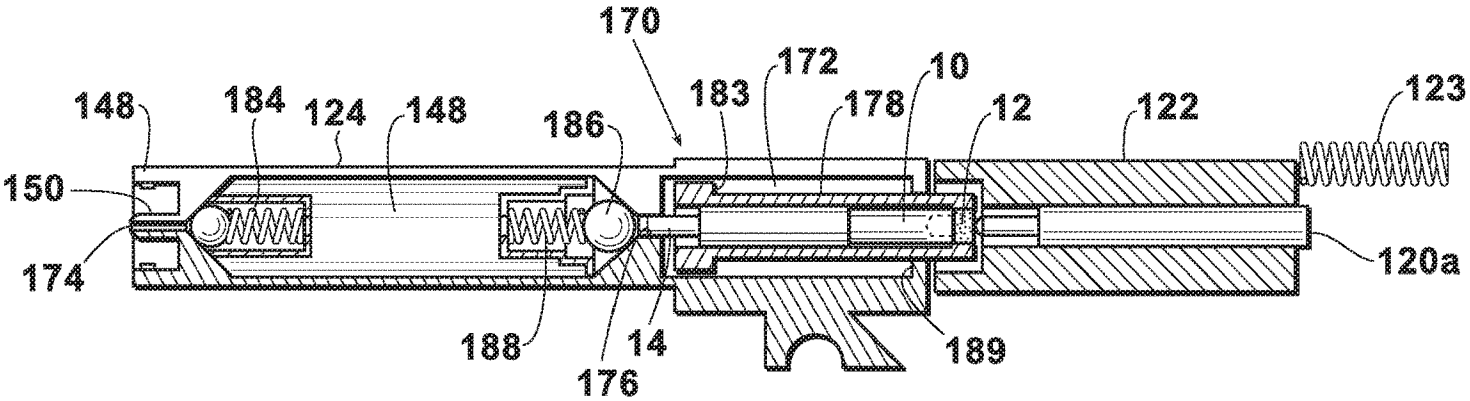
FIGS. 11 and 12 are cut-away side views illustrating an embodiment of a simulated barrel unit for use in converting an actual handgun into a simulated handgun, the embodiment including the composite striker of the present disclosure.
Figure 12:
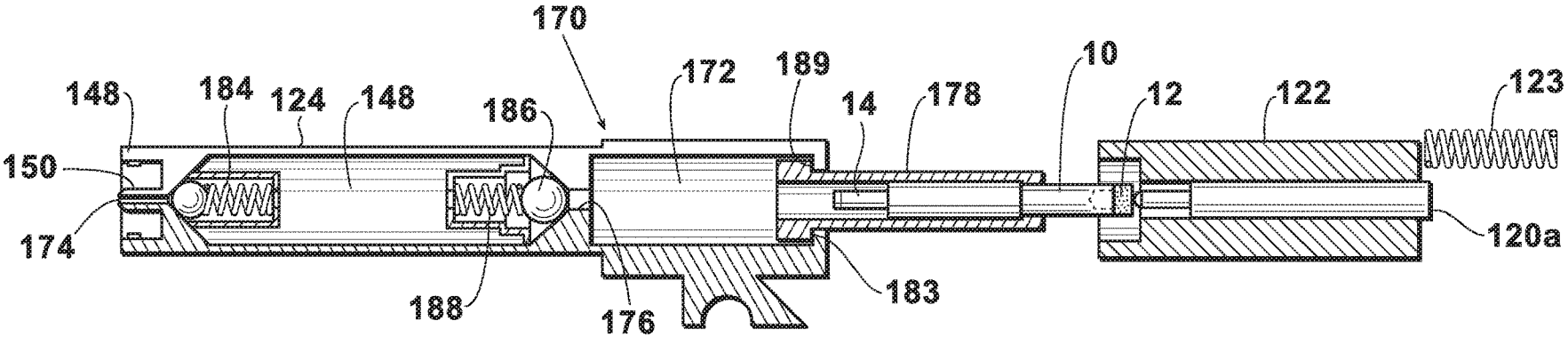

Referring to FIGS. 10-12, the simulated firing of handgun 100 shall next be described. The simulated barrel unit 124 includes a housing 170 which contains a chamber 172 and the reservoir 148. Fill port 150 is positioned at threaded end 148*a* of housing 170 and chamber 172 is at an opposite end of housing 170. Reservoir 148 includes an inlet 174 in fill port 150 at end 148*a* and an outlet 176 fluidly connecting reservoir 148 with chamber 172. A piston 178 includes composite striker 10 of the present disclosure movably retained in piston 178.

Fill port 150 is provided with a one-way check valve, which may be a tappet or ball valve 182, or other shaped valve member, which is resiliently urged by spring 184 to seat and seal inlet 174. A second or metering valve 186 is provided which may also be a tappet valve of a ball or other suitable shape, which is resiliently urged by spring 188 to seat and seal outlet 176. Actuation of trigger 120*b* in trigger portion 120 urges firing pin 120*a* into engagement with composite striker 10 of the present disclosure. The strike impulse transfers through first segment/anvil 12 and to second segment 14 such that composite striker 10 is moved sufficiently to unseat valve 186 and admit compressed gas from reservoir 148 into chamber 172.

As a result, slide portion 122 and piston 178 are urged rearwardly along with composite striker 10 of the present disclosure. Shoulder 183 of piston 178 in the embodiment of FIGS. 11 and 12 stops further rearward movement of piston 178 due to engagement with a shoulder 189 of chamber 172. The slide 122 continues in further rearward motion until venting occurs followed by forward motion of the slide 122 due to a recoil spring 123. During the recoil cycle, FIG. 12 when piston 178 stops moving aft, composite striker 10 telescopes out of piston 178 and moves the slide 122 rearward, thus harnessing energy of the compressed gas to do useful work.

When composite striker 10 passes across exhaust vent 178*a*, pressure escapes with an audible puff. In several applications shown herein, metering is achieved by predetermined stiffness of a spring (or other resilient member) and predetermined movement of the valve tappet (ball or other shape). A valve housing sets compression of the valve spring and limits movement of the valve tappet. This determines the time duration of the valve to stay open, which meters the amount of gas injected into an associated recoil chamber, e.g. 172, 190, which produces the desired amount of recoil.

In the embodiment of FIGS. 11 and 12, composite striker 10 of the present disclosure is held captive within piston 178. The embodiment of FIGS. 11 and 12 is set forth in greater detail in U.S. Pat. No. 9,297,607, incorporated herein by reference in its entirety. As a result, it is contemplated to be advantageous to be able to replace the first segment/anvil 12 of composite striker 10 and not the entirety of composite striker 10.

Figure 13:
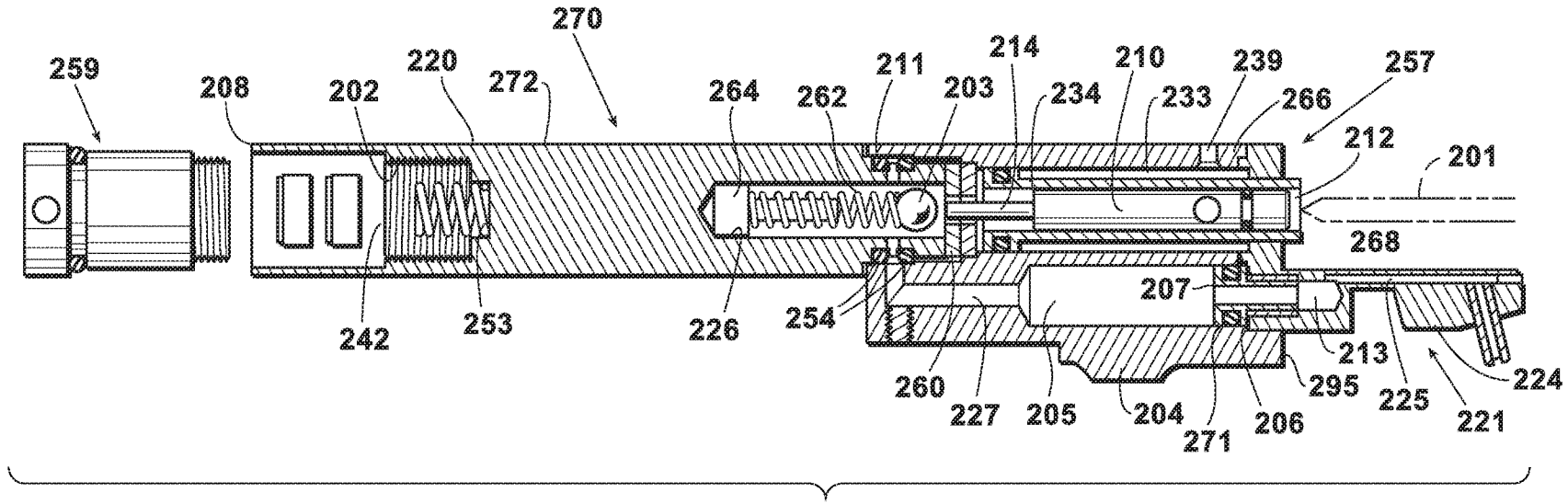
FIGS. 13 and 14 are cut-away side views illustrating an alternate embodiment of a simulated barrel unit for use in converting an actual handgun into a simulated handgun, the embodiment including the composite striker of the present disclosure.
Figure 14:
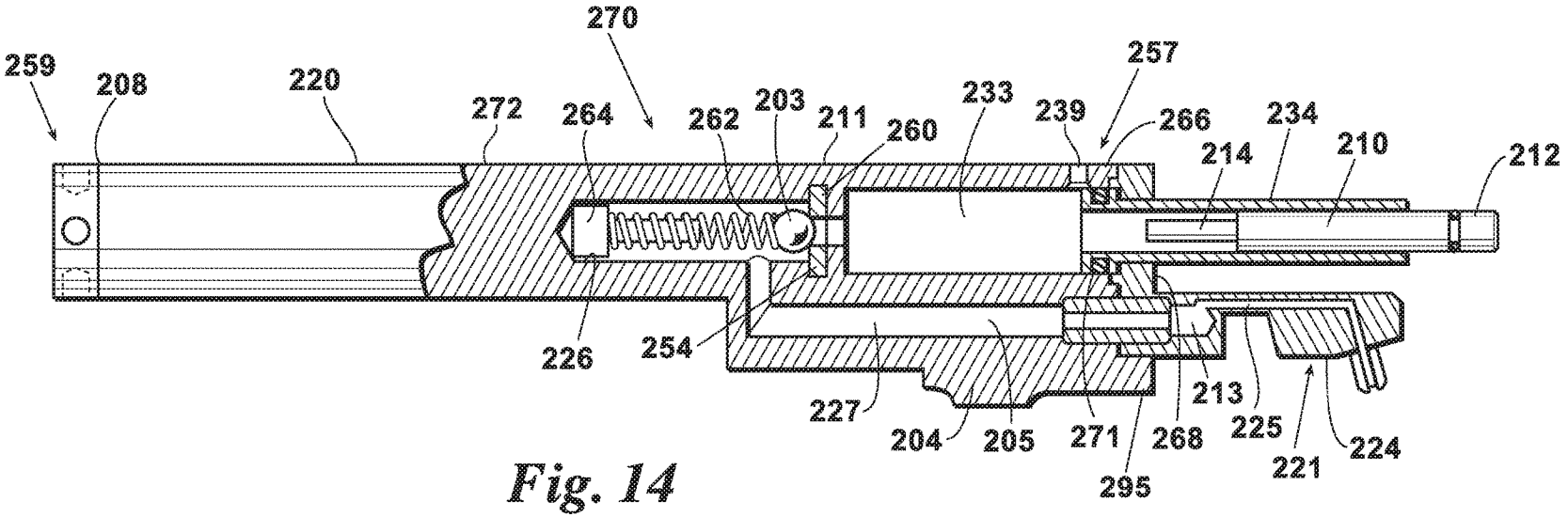

With regard to the embodiment of FIGS. 13 and 14, composite striker 10 of the present disclosure is not held captive and is thus removable for repair or replacement. The embodiment of FIGS. 11 and 12 is set forth in greater detail in U.S. Pat. No. 8,602,784, incorporated herein by reference in its entirety. Although it is contemplated to still be advantageous to replace the first segment/anvil 12 of composite striker 10, it is also contemplated that the entirety of composite striker 10 may be replaced.

Next, with reference to FIGS. 13 and 14, the non-captive composite striker embodiment shall be described. In this embodiment of the simulated barrel unit 270, the simulated barrel unit 270 has a multiple piece design to allow the barrel to be received in a frame that will not accommodate a one-piece barrel. In this embodiment, the composite striker 210 is of the design of the present disclosure. Composite striker 210 includes at least a first segment 212 and at least a second segment 214 and is substantially the same as striker 10, and may be configured to include any of the embodiments depicted in FIGS. 1-9 as discussed above. The difference of composite striker 210 being that in the simulated barrel unit 270 of FIGS. 13 and 14, composite striker 210 is not captive in piston or compressed gas chamber 233. First segment 212 receives a strike impulse from a firing pin 201. It is contemplated that firing pin 201 is the firing pin from the actual handgun. First segment 212 of composite striker 210 is constructed of a material which is softer than firing pin 201. First segment 212 is designed to receive a direct impact, and thereby the strike impulse, from firing pin 201 and transfer the strike impulse to second segment 214 without permanent deformation. Second segment 214 transfers the strike impulse to unseat a tappet valve 203. The ball in the embodiment of tappet valve 203 is biased against valve seat 260 by spring 262. Spring 262 is retained in gas chamber 226 by an anchor 264.

Simulated barrel unit 270 comprises a barrel 20, a compressed gas valve means 157, a compressed gas valve retaining means 221 and the firing mechanism actuated laser beam pulse emitting means 259. The compressed gas valve means 257 further comprises a compressed valve assembly. The compressed gas valve retaining means 221 further comprises a barrel extender seal, a barrel extender seal retainer 207 and a barrel extender retainer seal 271.

Barrel 220 includes a barrel first section 272, and a barrel second section 204 where the barrel 220. Barrel first section 272 having a laser module cavity 242 situated at the barrel first section first end 208, a first gas chamber 226 situated at the barrel first section second end 211 and a plurality of threads along the exterior of the barrel first section second end 211. Barrel 220 also includes laser module cavity 242 and the first gas chamber 226. Barrel second section 204 having a predetermined shape and located at the second barrel end 295. The barrel second section 204 having a compressed gas valve cavity 233, a barrel channel 227, a valve housing chamber 205, and a plurality of barrel o-rings 254. The compressed gas valve cavity 233 is adjacent to and in fluid communication with the first gas chamber 226 at the barrel second section first end 211 and having a bore vent 239 and a compressed gas valve cavity notch 266. A plurality of threads on the exterior of the barrel first section 272 at the barrel first section second end 211 mate with the plurality of threads in the interior surface of the compressed gas valve cavity 233 at the barrel second section first end 211 to join barrel first section 272 to barrel second section 204.

The plurality of barrel o-rings 254 having the shape of an o-ring made from polymer material in a preferred embodiment where the plurality of barrel o-rings 54 are received on the plurality of threads along the exterior of the barrel first section second end 211 such that the plurality of barrel o-rings 254 are situated between the joint of the barrel first section 272 and the barrel second section 204, that exists when the barrel first section 272 and the barrel second section 204 are mated together, to prevent compressed gas from escaping. Bore vent 239 is an opening in the compressed gas valve cavity 233 having a predetermined diameter in a predetermined location of the compressed gas valve cavity 233 such that bore vent 239 provides a path to vent the compressed gas from the compressed gas valve cavity 233 to the exterior of barrel 220. The compressed gas valve cavity notch 266 is situated at the second barrel end 295

Laser module cavity 242 is situated at the barrel first section first end 211 of the barrel first section 272 at the first barrel end 294. The plurality of laser module cavity threads 202 are situated along the inside diameter of the first laser module cavity 252 and where the second laser module cavity 253 is situated next to the end of the first laser module cavity 252 that is opposite the end of the first laser module cavity 252 located at the first barrel end 294 and in fluid communication with the first laser module cavity 252. One end of the valve housing chamber 205 is situated at one end of the barrel channel 227 to provide a path for compressed gas to flow from valve housing chamber 205 through barrel channel 227 to compressed gas valve cavity 233.

Barrel extender 221 includes a barrel extender base 224, a barrel extender piston opening 268, a barrel extender channel 225, a second barrel extender seal chamber 213, and a mating pin 223. The barrel extender base 224 being received in the frame to allow the barrel extender base 224 to be received in the compressed gas valve cavity notch 266 to connect the barrel extender base 224 to the barrel second section second end 213 at the second barrel end 295. The barrel extender base 224 being situated in a predetermined location which is substantially against the barrel second section second end 213 and beneath the compressed gas valve cavity 233 such that the barrel extender 221 extends longitudinally beyond the barrel second section end 213. The barrel extender base 224 cooperates with the frame to removably connect the second barrel extender seal chamber 213, the barrel extender retainer seal 271, the barrel extender seal retainer 207 and the valve housing chamber 205 together. The barrel extender piston opening 268 being situated in the barrel extender base 224 that is located at the second barrel end 295 such that the barrel extender piston opening 268 is substantially in the center of the predetermined diameter of the compressed gas valve cavity 233 such that the barrel extender piston opening 268 receives the piston 234 within the barrel extender piston opening 268 to retain piston 234 in the compressed gas valve cavity 233 and to guide piston 234 as is moves within compressed gas valve cavity 233.

The barrel extender seal retainer 207 is received inside valve housing chamber 205, and a barrel extender seal groove 206 being situated in a predetermined location in the exterior surface of the barrel extender seal retainer 207 with a predetermined depth and a predetermined width.

As shown in FIG. 13, the barrel extender retainer seal 271 being made from polymer material having the shape of an o-ring in one preferred embodiment and being received in the barrel extender seal groove 206 such that the predetermined diameter of the predetermined length of the barrel extender seal retainer 207 places the barrel extender retainer seal 271 in substantial contact with the interior surface of the valve housing chamber 205 to seal the barrel extender seal retainer 207 such that the compressed gas is prevented from passing between the exterior surface of the barrel extender seal retainer 207 and the interior surface of the valve housing chamber 205.

One end of second barrel extender seal chamber 211 is in fluid communication with barrel extender channel 225 and the other end of the second barrel extender seal chamber 211 is situated at the exterior of the barrel extender base 224, whereby the mating pin 224, the barrel extender channel 225, the second barrel extender seal chamber 211, the barrel extender seal retainer 207, the barrel extender retainer seal 271, the valve housing chamber 205 and the barrel channel 227 cooperate to provide fluid communication between the mating pin 224 and the compressed gas valve cavity 233 to allow compressed gas to flow from the mating pin orifice 295 to the first gas chamber 226.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Terms of approximation (e.g., "about", "substantially", "approximately", etc.) should be interpreted according to their ordinary and customary meanings as used in the associated art unless indicated otherwise. Absent a specific definition and absent ordinary and customary usage in the associated art, such terms should be interpreted to be ±10% of the base value.

When, in this document, a range is given as "(a first number) to (a second number)" or "(a first number)–(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A composite striker for a firearm simulator which employs a metal firing pin and provides pneumatic recoil, the composite striker comprising:

at least a first segment; said first segment being constructed of a material which is softer than the metal firing pin;

at least a second segment; said second segment being configured for displacing a valve in order to initiate the pneumatic recoil.

2. The composite striker of claim 1 wherein the first segment and the second segment are joined together.

3. The composite striker of claim 2 wherein said second segment is constructed of the same material as said first segment.

4. The composite striker of claim 1 wherein the first segment and the second segment are a single piece.

5. The composite striker of claim 1 said first segment is configured as a substantially cylindrical plug and said second segment is configured to receive said cylindrical plug.

6. The composite striker of claim 5 wherein said second segment includes a proximal end and a distal end;

said proximal end including a cylindrical cavity configured to receive said plug.

7. The composite striker of claim 6 wherein said distal end is configured for displacing said valve.

8. The composite striker of claim 6 wherein said plug includes a length and said cylindrical cavity is configured to have a depth such that said depth is capable of receiving the length of said plug.

9. The composite striker of claim 6 wherein the plug includes an external circumference including threads thereon and said cavity including an internal circumference including threads which mate the threads of said external circumference of said plug.

10. The composite striker of claim 1 wherein said first segment includes a bung; said second segment includes a proximal end and a distal end;

said proximal end of said second segment including a cavity to receive said bung.

11. The composite striker of claim 10 wherein said first segment includes a substantially cylindrical shoulder having a diameter;

said bung being substantially cylindrical such that the diameter of said shoulder is greater than the diameter of said bung;

said cavity being cylindrical and of a diameter capable of receiving said bung.

12. The composite striker of claim 11 wherein said bung includes an external circumference including threads thereon and said cavity including an internal circumference including threads which mate the treads of said external circumference of said bung.

13. The composite striker of claim 1 wherein said second segment including a proximal end and a distal end;

said proximal end including a saddle extending therefrom;

said first segment being configured as a cap having a cavity adapted to receive said saddle.

14. The composite striker of claim 13 wherein said saddle is substantially cylindrical having a diameter;

said cavity in said cap being substantially cylindrical and having a diameter capable of receiving said saddle.

15. The composite striker of claim 14 wherein said saddle includes an external circumference including threads thereon and said cavity including an internal circumference including threads which mate the threads of said external circumference of said saddle.

16. The composite striker of claim 13 wherein said saddle includes a length and said cavity includes a depth capable of receiving said length of said saddle.

17. The composite striker of claim 16 wherein said proximal end of said second segment is substantially cylindrical having an external diameter;

said cap being substantially cylindrical and having an external diameter such that when said saddle is received in said cavity, said external diameter of said proximal end of said second segment is substantially the same as the external diameter of said cap.

18. A striker for a firearm simulator which is struck by the end of a firing pin to initiate a simulated firearm recoil, the striker comprising:

a first segment;

said first segment being constructed of a material capable of being struck repeatedly by the firing pin without blunting or deforming the firing pin end;

a second segment joined to said first segment;

said second segment being configured for initiating the simulated recoil.

19. The striker of claim 18 wherein said firing pin is constructed from a material and said first segment is constructed of a material which is softer than the material from which the firing pin is constructed.

20. A composite striker for a firearm simulator which is struck by a metal firing pin to initiate pneumatic recoil and including a second segment configured for displacing a valve in order to initiate pneumatic recoil, the composite striker comprising:

a first segment being constructed of a material which is softer than the metal firing pin;

said first segment adapted for being joined to the second segment.

* * * * *